United States Patent [19]

Sikina, Jr. et al.

[11] 4,032,921

[45] June 28, 1977

[54] BROAD-BAND SPIRAL-SLOT ANTENNA

[75] Inventors: Thomas V. Sikina, Jr., Chalfont; Robert H. Schafer, Perkasie; Robert T. Klopach, Lansdale, all of Pa.

[73] Assignee: American Electronic Laboratories, Inc., Colmar, Pa.

[22] Filed: Sept. 8, 1975

[21] Appl. No.: 610,985

[52] U.S. Cl. ..... 343/730; 343/769; 343/895

[51] Int. Cl.[2] ..... H01Q 1/38; H01Q 13/18

[58] Field of Search ..... 343/730, 769, 895

[56] References Cited

UNITED STATES PATENTS

| | | | |
|---|---|---|---|
| 2,508,085 | 5/1950 | Alford | 343/769 |
| 3,568,206 | 3/1971 | Sisson et al. | 343/769 |
| 3,820,117 | 6/1974 | Hall et al. | 343/895 |

*Primary Examiner*—Eli Lieberman

*Attorney, Agent, or Firm*—Jacob Trachtman

[57] ABSTRACT

A broad-band antenna device comprising a variable aperture element which radiates or receives signals in the high frequency portion of the band and a pair of fixed aperture elements which radiate or receive signals in the low frequency portion, the variable aperture element comprising a planar spiral antenna element with a double winding which is electrically coupled to the fixed aperture elements comprising a pair of oppositely positioned center fed slot antenna elements.

10 Claims, 4 Drawing Figures

FIG. 2
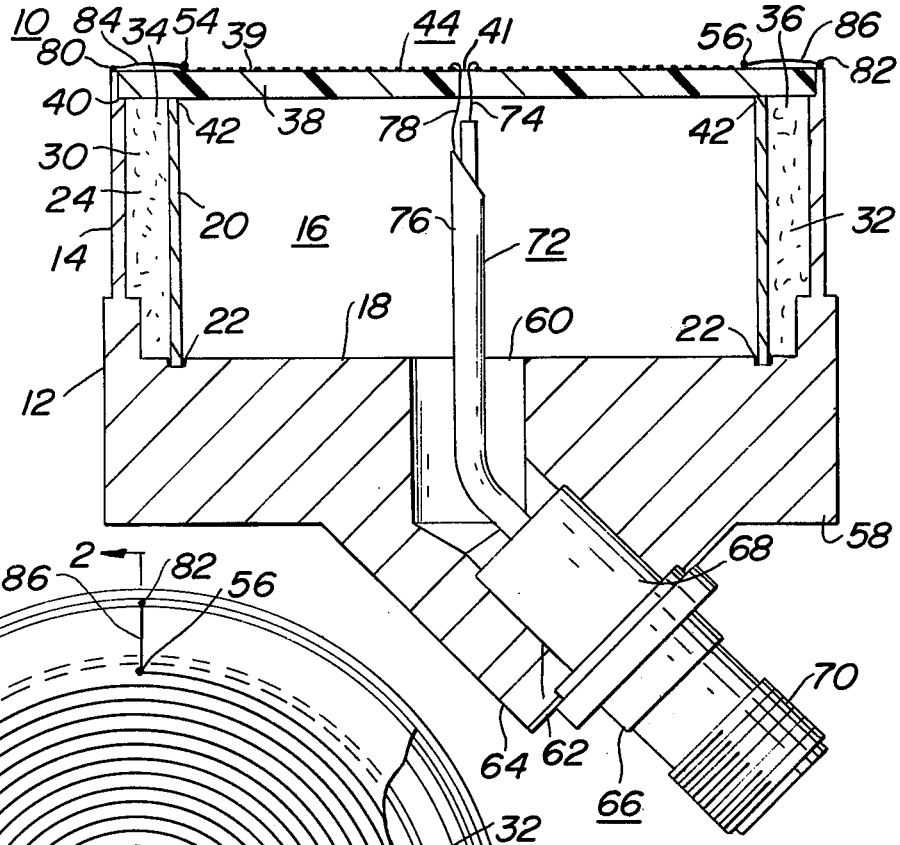
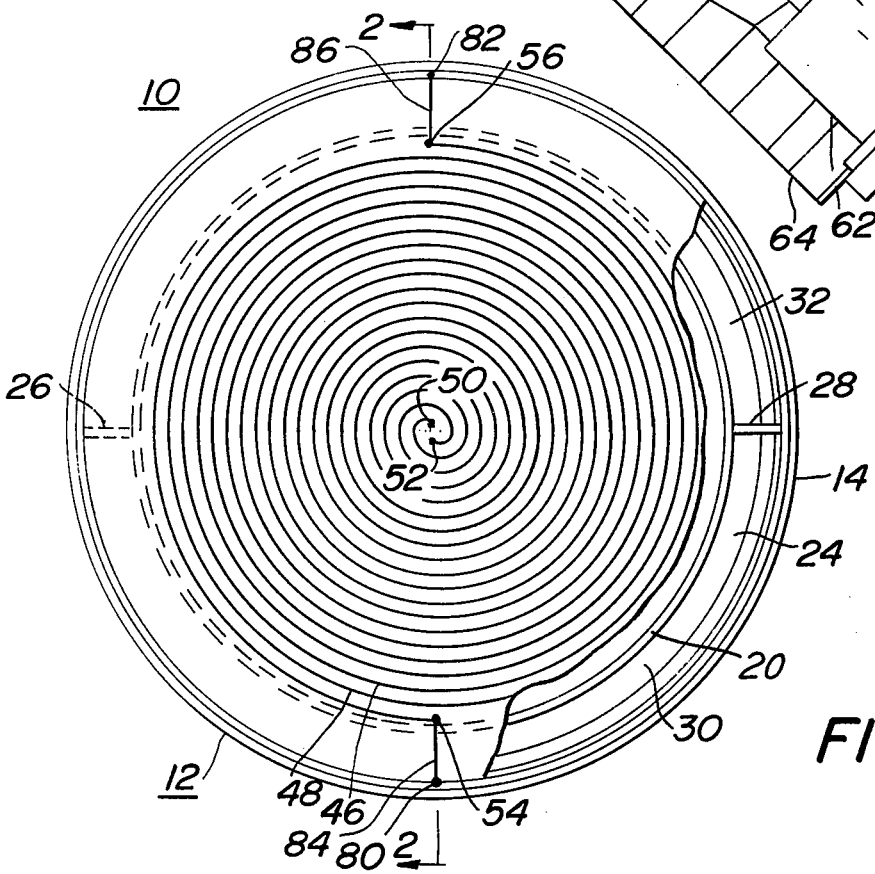
FIG. 1

ANTENNA RADIATION PATTERNS
CURVE A 600 MHZ
CURVE B 2.5 GHZ

BROAD-BAND SPIRAL-SLOT ANTENNA

The invention relates to a broad-band antenna and more particularly to an antenna with an extended operating range utilizing a combination of a spiral antenna element and a pair of slot antenna elements.

Antenna devices are provided for radiating and or receiving signals in a frequency band of limited range. The band widths of such antenna devices are limited by their respective physical configurations, particularly where high frequency signals are to be received and or radiated and it is desirable to extend the low frequency end of the received and or radiated frequency band. In providing extended low frequency response it is also desirable that the energy radiated in the lower end of the frequency band be compatible with and have a radiation pattern which is similar to the radiation pattern of the higher frequency signals which are to be radiated.

It is therefore an object of the invention to provide a new and improved broad-band antenna which has an extended frequency range with respect to conventional antenna devices.

Another object of the invention is to provide a new and improved broad-band antenna which provides a radiation pattern which is substantially similar over the entire frequency band.

Another object of the invention is to provide a new and improved broad-band antenna which has an extended low frequency band without being substantially increased in size over the size of conventional antenna devices covering the higher frequency portion of the frequency band.

Another object of the invention is to provide a new and improved broad-band antenna comprising an array of elements having minimal space requirements and being of high efficiency.

Another object of the invention is to provide a new and improved broad-band antenna providing a single unidirectional beam over the operating frequency range.

Another object of the invention is to provide a new and improved broad-band antenna which is usable in a ground plane mode when mounted in the metal surface of an aircraft.

The above objects as well as many other objects of the invention are achieved by providing a broad-band antenna comprising a variable aperture element such as a spiral antenna element and a fixed aperture element such as a slot antenna element electrically coupled with the variable aperture element. The spiral antenna element is supported by a body at its top region. The body has an annular slot with conductive walls which are partitioned by a pair of conductive end wall sections dividing the slot into two semicircular slots. The semicircular slots form a pair of oppositely positioned concentric slot antenna elements.

The spiral antenna element is supported within the boundary of the annular slot on a disc of nonconductive material positioned over and enclosing a central cavity in the body providing a cavity backed spiral antenna. The spiral antenna element has a double winding with each winding having an inner end at the center of the spiral antenna element spaced from the inner end of the other winding and an outer end at the periphery of the spiral antenna element.

Signal transmitting means which are secured with the body deliver signals to the inner ends of the spiral antenna element or alternatively receive signals therefrom. Connecting means electrically couple the outer ends of the windings of the spiral antenna respectively with the first and second slot antenna elements at their center feed points spaced intermediate their end wall sections.

The perimeter of the spiral antenna element is equal to or greater than a predetermined low cut-off wavelength of the spiral antenna element and the diametric distance between the slot antenna elements does not exceed one-half of said wavelength. The broad-band antenna operates as either a signal receiving or radiating antenna while providing a similar radiation pattern over its entire operating frequency range.

The foregoing and other objects of the invention will become more apparent as the following detailed description of the invention is read in conjunction with the drawing, in which:

FIG. 1 is a top plan view with portions broken away of a broad-band antenna embodying the invention;

FIG. 2 is a sectional view taken on the line 2—2 of FIG. 1;

Like references designate like parts throughout the several views.

Figure 3:
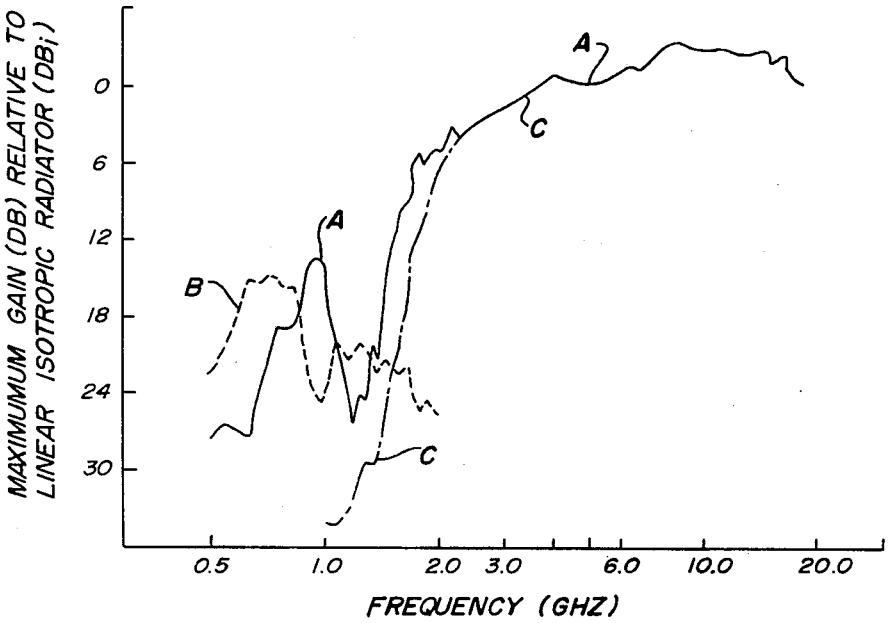
FIG. 3 is a graph illustrating the maximum gain relative to linear isotropic, of the antenna mounted in a ground plane of three feet in diameter.

Referring to FIGS. 1 and 2, the broad-band antenna 10 of the invention has a housing 12 which is made of a conductive material which may be aluminum provided with a copper finish. The housing 12 is substantially cylindrical in form having an outer circular wall 14 surrounding and forming a cavity 16 within the housing 12. The cavity 16 has a bottom inside wall 18 and receives within it a circular inner wall 20 which is concentric with the outer wall 14. The inner wall 20 is secured at its bottom end 22 with the bottom inside wall 18 by soldering or other suitable means. The inner wall 20 is also made of a suitable electrically conductive material and is spaced from the outer wall 14 to provide an annular slot cavity 24 of constant width about the periphery of the housing 12.

A pair of end wall sections 26 and 28 also made of electrically conductive material are received diametrically opposite to each other within the annular cavity 24, and extend in the radial direction between and in engagement with the inner and outer walls 20 and 14. The end wall sections 26 and 28 divide the annular cavity 24 into a pair of identical semicircular antenna slot elements 30 and 32. The slot antenna elements 30 and 32 are formed by the openings 34 and 36 at the top of the outer and inner walls 14 and 20 and the cavities of the slots 30 and 32 may be filled with ferrite loading material to the top openings 34 and 36 for obtaining desired impedance loading characteristics over the frequency band.

The housing 12 has a top plate 38 in the form of a disc which is made of a nonconducting material such as Teflon glass. The outer edge of the plate 38 is received and supported on a shoulder 40 on the inside surface of the outer wall 14 and on and over the upper end 42 of the inner wall 20, enclosing the cavity 16 and the cavities of the pair of slot antenna elements 30 and 32.

The plate 38 on its top surface 39 supports a spiral antenna element 44 comprising a pair of spaced spiral conductive lines 46 and 48 providing a double winding with respective inner feed points or ends 50 and 52 at the center 41 of the plate 38 and outer feed points or ends 54 and 56 at their outer periphery of the spiral antenna element 44. The spiral double winding of the spiral antenna element 44 is positioned on the outer surface of the plate 38 providing a planar spiral antenna element. The conductive lines 46 and 48 may be provided on the plate 38 by printed circuit board techniques or by any other suitable method.

The spiral windings 46 and 48 may be characterized as circularly symetrical, are of equal physical length and electrically balanced. Since the inner ends 50 and 52 are positioned opposite each other, this results in the outer ends 54 and 56 of the windings 46 and 48 being also positioned diametrically opposite to each other with a 180° angular displacement as clearly illustrated in FIG. 1.

The housing 12 has a bottom portion 58 with a central opening 60 communicating with the cavity 16 at its center and an angularly disposed opening 62 joined with the opening 60 and extending out of the housing 12 through a protruding portion 64 of the housing 12. A balun assembly 66 has an upper portion 68 received and retained in the opening 62 of the housing 12 while providing an external cable connector 70 which extends at a downward angle for being connected to a coaxial cable means (not shown) for receiving energization from or delivering energization to the broadband antenna 10.

The upper end 68 of the balun assembly 66 is electrically joined with a transmission line 72 which may be a coaxial line having an inner conductor 74 and an outer shield conductor 76. The coaxial conductor 72 passes upwardly through the opening 60 and the cavity 16 towards the center 41 of the disc shaped plate 38. The center conductor 74 of the cable 72 passes through the center region of the plate 38 and is electrically connected by soldering or other means with the inner end 50 of the spiral antenna element 44. The outer conductor 76 of the coaxial cable 72 is connected to a wire conductor 78 which also passes through the center region of the plate 38 and is electrically connected to the inner end 52 of the spiral antenna element 44.

The planar spiral antenna element 44 has its outer periphery positioned to lie over the center portion of the cavity 16 within the boundary of the inner wall 20 so that the spiral antenna element 44 does not extend over the openings 34 and 36 of the slot antenna elements 30 and 32. The outer ends 54 and 56 of the windings 46 and 48 are located above the end 42 of the cylindrical inner wall 20 and within the boundary of the inner wall 20. The outer end 54 of the winding 46 of the spiral antenna element 44 is angularly positioned midway between the end wall sections 26 and 28 of the slot antenna element 30 while the end 56 of the winding 48 of the antenna element 44 is positioned diametrically opposite to the end 54 and also angularly midway between the end wall sections 26 and 28. The outer ends 54 and 56 are respectively connected by a conducting wire 84, 86 to opposite respective points 80 and 82 at the top of the outer wall 14. The diametrically opposite points 80 and 82 are the center feed points respectively for the slot antenna elements 30 and 32.

In operation the broad-band antenna 10 because of its compact size may readily be mounted in the metal surface of an aircraft for use in the ground plane mode. Conducting ground planes of three feet in diameter and less have been found to provide satisfactory ground mode operation for the antenna. Of course, the antenna may be used in other structures and applications where a compact configuration of high efficiency and broad-band characteristics are desirable.

The antenna device 10 may be used both for radiating signals and receiving signals propagated from a remote location without change in the antenna structure. When signals are to be radiated by the antenna 10, such signals may be delivered from a source by coaxial cable or other transmission means, although the antenna device 10 provides for connection with a coaxial cable at the connector 70. Such signals are delivered by the connector 70 of the balun unit 66 to its upper portion 68 which contains a conventional balun circuit. The balun circuit provides a balanced output signal of proper impedance to the transmission line 72. The line 72 provides two output conductors 74 and 78 at its end delivering an output signal which is balanced with regard to ground potential.

The signal to be radiated is, thus, transmitted to the inner ends 50 and 52 of the planar spiral antenna element 44. The planar spiral antenna element is a variable aperture antenna device and radiates signals of a particular frequency or wavelength in the region where its conductors 46 and 48 have a circular circumference equal to or an integer multiple of the wavelength of the presented signals. Thus, signals with high frequency having short wavelengths will also be radiated close to the center 41 of the antenna 44, while signals with lower frequencies and longer wavelengths will be radiated at locations at increased distance or radius from the center 41, providing the variable aperture operation of the spiral antenna element 44.

As the frequency decreases and the wavelength becomes longer, a point is reached where the effectiveness of the spiral antenna element 44 is reduced in view of the maximum circumference provided by the spiral antenna element 44. When the frequency of the signal to be radiated is below the radiation frequency range for the spiral antenna element 44, the pair of lines 46, 48 of the spiral antenna element 44 act as a balanced transmission line. Under such conditions the signals transmitted by the lines 46, 48 are in phase opposition or 180° out of phase and have the same absolute potential to ground potential, with the cavity of the spiral antenna element 44 formed by the inner wall 20 and the inner bottom wall 18 being considered to be at ground potential.

The delivery of such low frequency signals to the spiral antenna element 44 provides output signals at the ends 54 and 56 which are 180° out of phase. These out of phase signals are delivered to the center feed points 80, 82 of the pair of slot antenna elements 30 and 32 activating them to radiate signals at the low end of the frequency range.

Although the signals delivered for energizing the slot antenna elements 30 and 32 are out of phase, the opposing symetrical arrangement of the slot antenna elements 30 and 32 results in the production of radiated signals which are in phase. This is explained by the fact that the radial directions from the inner wall 20 to the outer wall 14 are 180° out of phase at the respective feed points 80 and 82 of the slot antennas 30 and 32 which difference is compensated for by the 180° phasing of the signals delivered to the feed points 80 and 82.

This provides a vector potential between the inner and outer walls 20 and 14 which are coordinated and in the same direction. The amplitudes are also equal in view of the balanced signal provided at the outer ends 54 and 56 of the lines 46 and 48.

The tangents to the slot antenna elements 30 and 32, at the diametrically opposite feed points 80 and 82 are parallel to each other, and the slot antenna elements 30 and 32 in these regions simulate the performance of a pair of spaced parallel slot elements. It is noted that the greatest amplitude voltage variations of the slot antennas 30 and 32 also take place at the feed points 80 and 82 while the voltages produced towards the ends of the slot antenna elements 30 and 32 are reduced approaching the end sections 26 and 28. This results in the slot antenna elements 30 and 32 producing a linearly polarized output signal in the direction parallel to the diametric line defined by the feed points 80 and 82.

The slot antenna elements 30 and 32 are center fed dipole elements which efficiently provide radiation in the lower part of the frequency band, while the spiral antenna element 44 produces output signals which are circularly polarized over its upper frequency range.

The spiral antenna element 44 generates a single lobe pattern which is in the axial direction perpendicular to the plane of the top surface 39 of the plate 38 and centered on the center 41. To produce such radiation pattern, the lines 46, 48 of the spiral antenna 44 must be fed in phase opposition and the signal frequency must be in the frequency range for which the spiral diameter is large enough to radiate. The lower cut-off wavelength for the spiral antenna element 44 is given by the following expression:

$$\lambda s \leq \pi d \qquad (1)$$

where $\lambda_s$ is the cut-off wavelength and $d$ is the outer diameter of the spiral antenna element 44.

A slot positioned symetrically on each side of the spiral antenna 44 produces a balanced condition for the array maintaining an axially directed single lobed pattern, but only under the condition that the distance between the slot antenna elements 30 and 32 is equal to or less than one-half of their cut-off wavelength $\lambda_2$. Where the distance between the slot antenna elements is greater than this value, a null occurs producing a multi-lobed pattern coincident with the single lobed slot and spiral patterns which are produced under the stated conditions.

Thus the condition under which the spiral antenna element 44 and the slot antenna elements 30 and 32 complement each other and provide a single lobed axial radiation pattern are given as follows:

$$\lambda_s/\pi \leq d_s \leq \lambda_s/2 \qquad (2)$$

where $d_s$ is the distance between slot antenna elements 30 and 32 or the outer diameter of the circumference or periphery of the spiral antenna element 44.

Thus, the low frequency cut-off wavelength of the spiral antenna element 44 is equal to or less than the outer circumference or perimeter of the spiral antenna element 44, and the separation or distance between the slot antenna elements 30 and 32 is equal to or does not exceed one-half of their cut-off wavelength.

As an example of a broad-bend antenna 10, the spiral antenna element 44 was provided with an outer diameter $d_1$ of 2 inches while the diameter $d_2$ of the slot element 30 and 32 taken at the midpoint between their outer and inner walls 14 and 20 was 2.135 inches with a slot length of 3.35 inches providing a slot wavelength of 6.28 inches.

Figure 4:
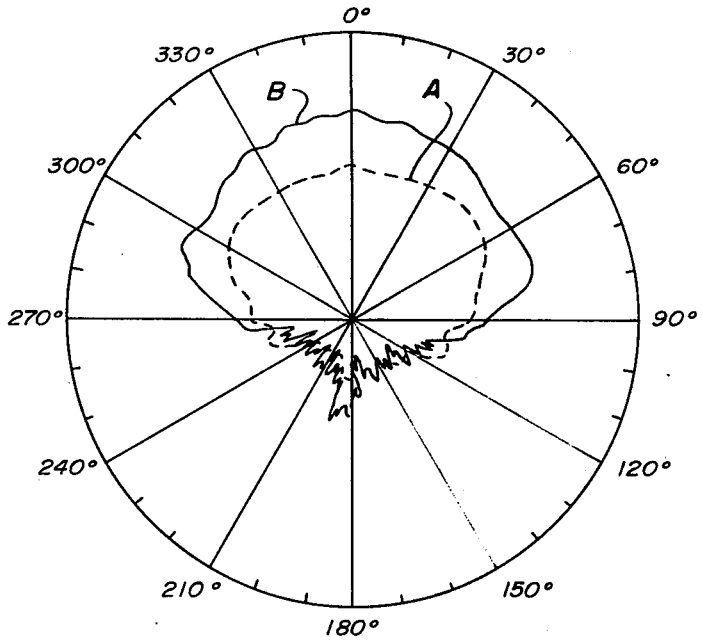
FIG. 4 is a graphic illustration in polar form of a high frequency and a low frequency radiation pattern of the broad-band antenna.

FIGS. 3 and 4 provide a graphic illustration of the gain versus frequency and radiation patterns for a broad-band antenna 10 embodying the invention with the above dimensional specifications.

The curve A of FIG. 3 illustrates the maximum gain of the antenna 10 relative to a linear isotropic radiator and shows a range extending from 0.5 GHZ to 20 GHZ. The antenna was mounted in a ground plane which was three feet in diameter. The curve B illustrates the gain over the frequency band for the slot antenna elements 30 and 32 fed by a balanced, 180° phased signals, in the absence of the spiral antenna element 44 to avoid interaction effects. Similarly curve C illustrates the gain curve of the spiral antenna element 44 in the absence of the slot antenna elements 30 and 32. In considering the curves A, B and C, it is noted that the curve A is not a simple composite of the curves B and C, but includes the interactions between the spiral antenna element 44 and slot antenna elements 30 and 32 in the low frequency end of the frequency range to provide the characteristic gain curve for the antenna 10 when the spiral antenna element 44 and slot antenna elements 30 and 32 are present and interconnected.

FIG. 4 graphically illustrates the radiation pattern of the broad-band antenna 10 when radiating in the low frequency portion of the frequency range and in the high frequency portion of the frequency range. The curve A represented by the dotted lines illustrates the radiation pattern of the broad-band antenna 10 at a frequency of 600 MHZ illustrating its single lobed form directed in the axial upward direction. The solid line curve B illustrates the radiation pattern for the antenna 10 at a frequency of 2.5 GHZ. At this higher frequency, the radiation pattern is still single lobed in the axial upward direction. The curves A and B are typical of broad-band unidirectional single lobed axial radiation patterns provided by the antenna 10 over its operative broad frequency range. It is also noted that the FIGS. 3 and 4 illustrate the characteristics of the antenna 10 in both a radiating and signal receiving mode of operation.

When operating in its signal receiving mode, the antenna device 10 is energized by signals propagated from a remote source. The slot antenna elements 30 and 32 upon receiving the lower frequency signals to which it is responsive, energizes the outer ends 54 and 56 of the lines 46 and 48 of the spiral antenna element 44 which act as a transmission line delivering the signals to the balun assembly 66. These signals are provided at the connector 70 as output signals. Similarly, the higher frequency signals which are received by the antenna 10 energize the spiral antenna element 44 in the regions corresponding to the wavelength of the received signal and produce high frequency output signals which are also delivered by the inner ends 50 and 52 of the spiral antenna element 44 over the connecting means 72 to the connector 70 for delivery concurrently with low frequency signals which may be present as an output signal.

Although the variable aperture antenna described in detail in connection with the antenna 10 is the planar spiral antenna element 44, other variable aperture antenna elements including planar, conical, spiral and helical antennas, as well as log periodic and other such devices may also be used to carry out the invention. Similarly other fixed aperture antennas in addition to the slot antenna elements 30 and 32 embodied in the antenna 10 of the invention may be utilized. Such fixed aperture antennas include but are not limited to electrical and magnetic dipole, monopole, conical slot, annular slot antennas and various configurations may be utilized. Accordingly it is noted that although a pair of semicircular slot antennas 30 and 32 were utilized in the disclosed broad-band antenna 10, linear, rectangular and other slot configurations and arrays may be utilized.

The broad-band antenna 10 illustrated provides a highly compact structure which for the particular embodiment described allows extended low frequency operation with a fixed aperture element while increasing the volume of the antenna by only 30% or less over the volume provided by the spiral variable aperture element.

The antenna is an integrated unit utilizing a single feed connector for the entire range of the operative band. The antenna 10 is also directly scalable to higher or lower frequency ranges in terms of the physical dimensioning of the structure. The operating frequency band width in octaves is approximately the same at higher or lower frequency ranges when the antenna is appropriately scaled.

It will be obvious to those skilled in the art that additional modifications and variations of the disclosed broad-band antenna will be readily apparent, and that the invention may find wide application with appropriate modification to meet the particular design circumstances, but without substantial departure from the essence of the invention.

What is claimed is:

1. A broad-band antenna device having a wide frequency band comprising a variable aperture element, and a fixed aperture element comprising a slot antenna positioned about and electrically coupled to said variable aperture element, the variable aperture element having first and second output points providing balanced output signals with a 180° phase difference, and said slot antenna including first and second slot antenna elements with the first slot antenna element being electrically coupled with the first output point of said variable aperture element and the second slot antenna element being electrically coupled with the second output point of said variable aperture element.

2. The device of claim 1 in which the variable aperture element is a spiral antenna element which radiates and receives signals in the high frequency portion of said band and has two windings with each winding having an inner end at the center of the spiral antenna element spaced from the inner end of the other winding and an outer end at the periphery of the spiral element, the inner ends of the windings providing signal feed points for the antenna and the outer ends of the windings providing feed points to said slot antenna.

3. The device of claim 2 in which the first and second slot antenna elements comprise a spaced array of antenna elements, said first and second slot antenna elements having a predetermined equal length and are respectively center fed at a center point intermediate their ends.

4. The device of claim 3 in which the perimeter of the spiral antenna element is not smaller than a predetermined low cut-off wavelength of the spiral antenna element and the first and second slot antenna elements are substantially parallel to each other in the region of their center points and are separated from each other between their center points a distance not exceeding one half of said cut-off wavelength of said variable aperture element.

5. The device of claim 1 which includes a body supporting said variable aperture element and having a slot therein with conductive walls providing the slot antenna elements of said fixed aperture element, said body having a cylindrical outer wall and a cylinderical inner wall positioned from the outer wall of said body to form between them the slot of said body with an annular configuration, and a pair of diametrically opposite radially extending wall sections positioned within said slot between said inner and outer walls providing first and second slot antenna elements of semicircular configuration.

6. The device of claim 5 in which said body has a top region and a central cavity bounded by said slot, and a non-conductive disc member mounted at the top of said body and enclosing the cavity of said body and supporting said variable aperture element at the top region of said body within the boundary of said slot.

7. The device of claim 4 in which said first and second slot antenna elements are positioned symetrically with said variable aperture element.

8. The device of claim 7 in which said first and second slot antenna elements are identical, semicircular in configuration, and positioned opposite one another about the same center point with their feed points being diametrically opposite to each other.

9. The device of claim 8 in which said first and second slot antenna elements are positioned in a plane and have an inner circumference and said variable aperture element is positioned within the inner circumference of said slot antenna elements.

10. The device of claim 8 in which the spiral antenna element is a cavity back spiral antenna element and said slot antenna elements are provided with a ferrite loading material.

* * * * *